US007421757B1

(12) United States Patent
Garcia, Jr.

(10) Patent No.: US 7,421,757 B1
(45) Date of Patent: Sep. 9, 2008

(54) PUMP VALVE MECHANISM

(75) Inventor: Ralph Garcia, Jr., Houston, TX (US)

(73) Assignee: AIMM Technologies, Inc., Texas City, TX (US)

( * ) Notice: Subject to any disclaimer, the term of this patent is extended or adjusted under 35 U.S.C. 154(b) by 781 days.

(21) Appl. No.: 10/920,079

(22) Filed: Aug. 17, 2004

(51) Int. Cl.
*B08B 9/43* (2006.01)

(52) U.S. Cl. ..... 15/304; 15/302; 15/321; 134/1; 134/167 C

(58) Field of Classification Search ..... 15/304, 15/302, 301, 321; 134/167 C, 184, 169 C, 134/1
See application file for complete search history.

(56) References Cited

U.S. PATENT DOCUMENTS 5,423,917 A * 6/1995 Garcia, Jr. ..... 134/1
5,493,754 A * 2/1996 Gurstein et al. ..... 15/321
5,647,089 A * 7/1997 Hollrock ..... 15/302
5,674,323 A * 10/1997 Garcia ..... 134/1
6,282,746 B1 * 9/2001 Schleeter ..... 15/302
7,141,118 B2 * 11/2006 Vaerewyck et al. ..... 118/50
7,306,001 B1 * 12/2007 Garcia, Jr. ..... 134/167 C

* cited by examiner

*Primary Examiner*—Lee D Wilson
(74) *Attorney, Agent, or Firm*—Law Office of Tim Cook P.C.

(57) ABSTRACT

A method for cleaning tubes and heat exchangers provides an oscillating pump/valve mechanism to provide a periodic waveform of shocks to fouled tubes. Preferably, a pair of pneumatic control valves operates an actuator to oscillate a valve within a valve block, and isolation of a fluid within a manifold in the block creates a pumping action from the valve, to create an intense fluid shock wave to clean interior surfaces tubes.

4 Claims, 3 Drawing Sheets

PRESSURE AIR
PRESSURE AIR
PRESSURE AIR
WATER
V REG.
V REG.
P
M
10
11
12
13
14
15
16
17
18
20
21
22
23
24
24
25
25'
26
32
36
37
38
39
40
41
42
43
44
45
46
48
50
51
66
76
80
82
92
94

20
25'
26
25
72
70
74
76
78
80
82
84
86
88
90
92
51

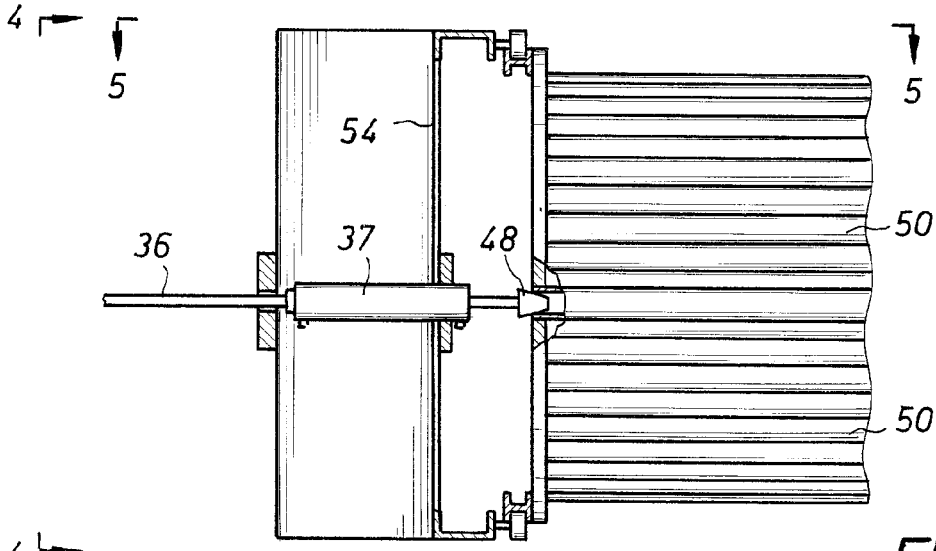
FIG. 3
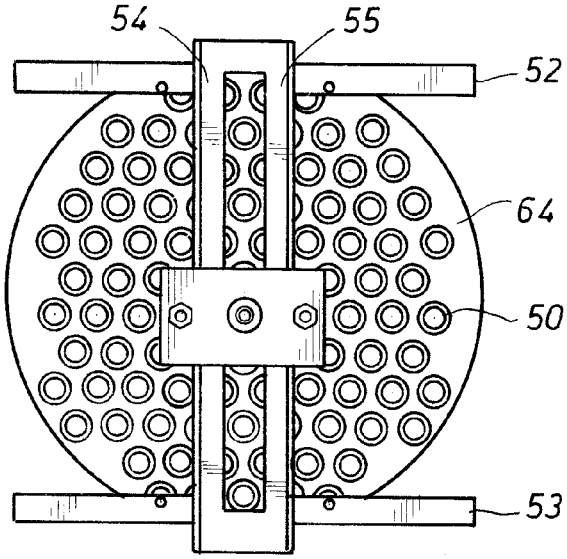
FIG. 4
FIG. 5
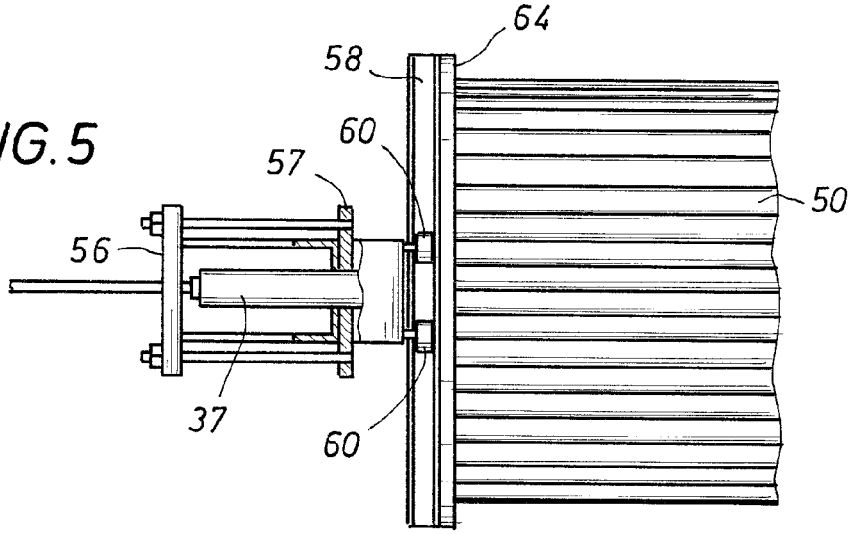

PUMP VALVE MECHANISM

FIELD OF THE INVENTION

The present invention relates generally to the field of devices for cleaning clogged heat exchanger tubes and, more particularly to a system for cleaning tubes within a vessel using a pump valve mechanism for mechanically applying variable pressure to material clogging the tubes.

BACKGROUND OF THE INVENTION

A heat exchanger is normally formed of a plurality of tubes oriented generally parallel to one another. In normal operation, a fluid to be heated or cooled is delivered through the inside of the tubes of such a heat exchanger. The outside surface of the tubes are contacted with a fluid which adds heat or removes heat as required. The plurality of generally parallel tubes forms a bundle. A set of end plates, known as heads, commonly support the bundle of tubes at each end.

Heat exchangers usually operate in a continuous fashion, often for months at a time. However, such continuous operation may be periodically interrupted to clean the tubes. The cleaning process is necessary to remove residue which collects on the inside surface of the tubes which reduces their heat transfer capability. The tubes are normally formed of metal which has a relatively high thermal conductivity. The material which may coat the interior of the tubes, however, has a much lower thermal efficiency for heat transfer. Therefore, the coating formed on the interior of the tubes is detrimental to the efficiency of the operation of the heat exchanger.

As residue builds up on the inside surface of a heat exchanger tube, the tube becomes less and less efficient. One way to counteract this effect is to raise the temperature differential across the tube. However, there are limits to this solution. For instance, the metal used in the tubes of the heat exchanger has a limited capacity for heat as a result of metallurgical considerations. Exceeding the design temperature differential across through the tubes increases fatigue and therefore reduces the useful lifetime of the heat exchanger.

In a well known U-tube design, the bundle of tubes takes a 180° bend or elbow at more or less the mid-point of the respective tubes. Fluid enters an inlet box which is separated by a divider plate from an outlet box. The fluid then flows through the head, through the tubes in first one direction then the reverse direction, back through the head and finally into the outlet box on the other side of the divider plate. Cleaning the tubes involves removing the accumulated coating material on the inside of the tubes and the difficulty of cleaning the inside surfaces of the tubes is exacerbated by the bend in the tubes. Also, as exchanger designs have improved, the effective length of the tubes has increased. This makes the task of cleaning the tubes more difficult because the long and relatively narrow tubes do not permit easy access to the tubes.

One way that the tubes can be cleaned is by pumping water or perhaps chemically active solvents into the tubes. That is successful but it has limitations. Moreover, since a typical heat exchanger includes a large number of tubes, it is necessary to undertake the cleaning in a repetitive fashion so that a large number of tubes can be cleaned.

In my U.S. Pat. No. 5,423,917, I described a system and a method for cleaning heat exchanger tubes. The system described therein has proven very successful. However, the system includes a control panel with a ganged set of valves to set up a shock wave to be injected into a tube. For particularly stubborn and tenacious fowling, especially involving hundreds of tubes, this manual alignment of the control panel valves can become tiresome and tedious. Therefore, there remains a need for a system like that described in the '917 patent but that mechanizes the shock wave generation process. The present invention is directed to solving this need in the art.

SUMMARY OF THE INVENTION

The present invention solves this need in the art by providing a pump/valve mechanism for directing a shock wave to a tube that is to be cleaned. A pump takes a suction from a sump and the pump discharges to an output and then through a valve which is switched to deliver water under pressure through a controllable orifice. The orifice delivers the water under pressure to the pump/valve mechanism which alternately directs pressurized water to the tube and to an overflow discharge.

In a preferred embodiment, the pump/valve mechanism is actuated pneumatically by regulated air pressure. However, any convenient and appropriate actuation means may be used.

In the rest of the tube cleaning system, a lance is provided to deliver pressurized water and the shock wave to the tubes. The lance is positioned by a ram, which cooperates with the lance to align the lance with individual tubes. The lance is directed in an X and Y pattern by a control mechanism to align with selected tubes. The lance is able to travel forwardly in the Z direction. It is constructed on a piston and cylinder mechanism which enables hydraulic control of lance insertion and retraction.

When the lance is inserted, the tip of the lance is placed in the particular tube to be cleaned. Hydraulic control enables rapid indexing of the lance to the left and right to align with the proper tube and to insert into that tube once alignment has been accomplished. The tip of the lance is profiled so that it forms a fairly quick seal with the end of the tube. The lance is hollow to deliver liquid through the end of the lance into the tube. A pressurized air supply provides air to the pump/valve mechanism to purge the tube to be cleaned to set the tube up for a water hammer action when the lance is pressurized with water or cleaning solution.

A pressure surge is set up by timed operation of the pump in cooperation with the orifice. Moreover, this delivers a flow of water into the tube. By appropriate shock wave creation with a mix of air and water injected violently into the tube, the corrosion materials collected on the inside of the tube are fractured and break away. There is a rapid flow of multiphase fluid through the tube. This rapid flow agitates the corrosion residue with sufficient shock tremors that the corrosion residue is broken and will flake off the wall. The loosened material is then flushed out of the tube by the continued flow of fluid from the lance.

These and other features of the present invention will be readily apparent to those skilled in the art from a review of the following description with the accompanying drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3 is a side view of a lance mounting mechanism showing a lance which extends to seat against a tube to enable tube cleaning;

FIG. 4 is a sectional view along the line 3-3 of FIG. 3 and shows details of construction of the mechanism which aligns the lance with a particular tube for cleaning; and FIG. 5 is a sectional view along the line 4-4 of FIG. 3 showing details of construction of the lance insertion mechanism.

DETAILED DESCRIPTION OF PREFERRED EMBODIMENTS

Figure 1:
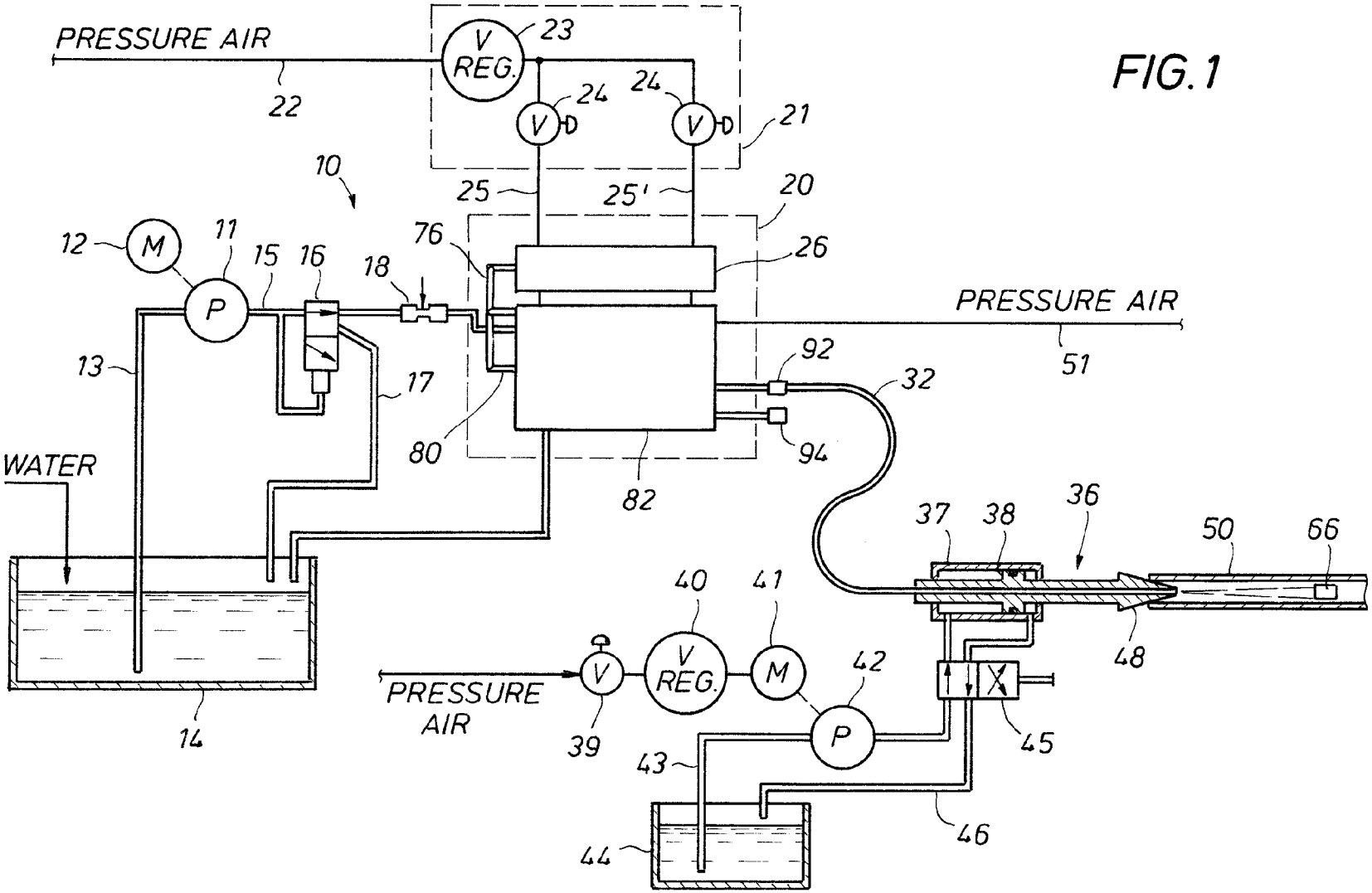
FIG. 1 is a schematic flow diagram of the system wherein the pump valve mechanism of the present invention finds application.

Attention is now directed to FIG. 1 of the drawings which illustrates a schematic of a system 10 for cleaning tubes and the like. The system includes a pump 11 driven by a suitable motor 12 of substantial power. The pump 11 takes a suction through a feed line 13 from a water sump or reservoir 14. Water level is maintained in the sump by occasional replenishment. Moreover, the water is typically pure but it can be used with additives. For instance, certain types of acids or bases can be added to accomplish chemical attack on the material to be removed.

The pump 11 has a pump output 15 which is provided to a control valve 16. The control valve 16 is a two position valve. In the illustrated position, water under pressure is delivered from the pump through an adjustable orifice 18. Alternatively, the valve 16 connects with a line 17 which provides a return to the sump. The orifice 18 provides a control signal to manifold 20 of a pump valve mechanism represented in phantom in FIG. 1 and described in greater detail below.

The manifold operates in conjunction with an air pressure manifold 21. Pressurized air is provided on an air line 22 into a regulator valve 23 in the air pressure manifold. The regulator valve 23 provides a regulated air pressure output through a pair of control valves 24. The control valves 24 are each of the same construction and connect in parallel at the output of the regulator 23. The manifold 21 may be replaced with other actuation means, including a hydraulic actuator, an oscillating electric switch, a gas pilot valve, or other means to control a pump/valve mechanism in the manifold 20.

Figure 2:
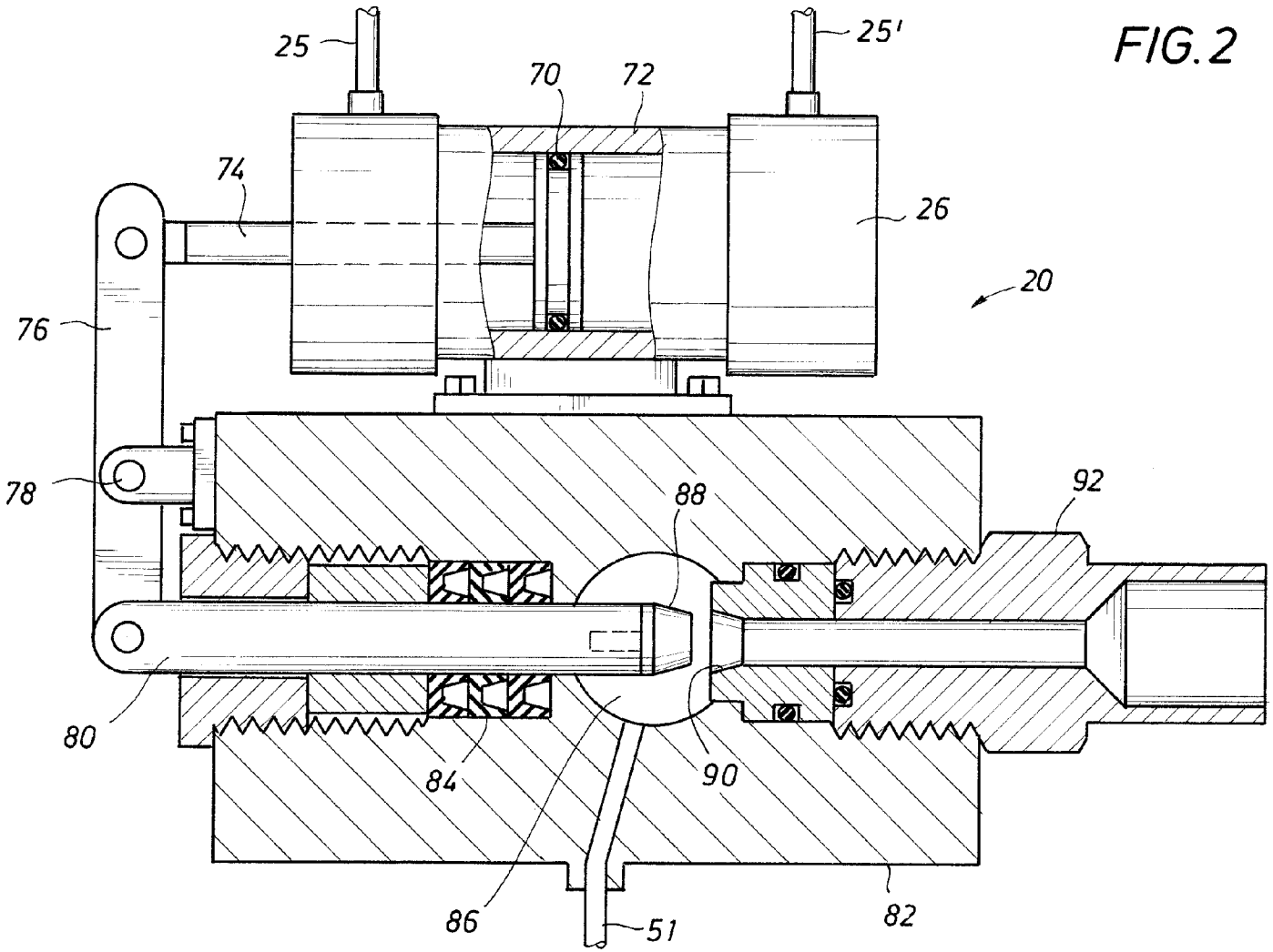
FIG. 2 is a section view of the pump/valve mechanism of this invention.

The control valves 24 in the manifold are input to the manifold 10 which includes the pump/valve mechanism. Specifically, the control valves 24 provide air inlet lines 25 and 25', respectively, to either side of an actuator 26. FIG. 2 provides greater detail of the pump/valve mechanism. As previously stated, the pump valve mechanism may be operated by any appropriate and convenient actuation means, but the pneumatic actuator is the preferred means and is illustrated.

As shown in FIG. 2, the air inlet lines 25 and 25' provide air pressure into the actuator 26. In the preferred embodiment, the actuator comprises a piston 70 within a cylinder 72. Air pressure ported to the air inlet line 25 moves the piston to the right as seen in FIG. 2, and air pressure ported to the air inlet line 25' moves the piston to the left. The piston 72 is coupled to a piston rod 74 which terminates at a linkage 76. The linkage 76 pivots about a fulcrum 78 and links to a valve rod 80. The valve rod 80 is mounted for movement within a pump/valve block 82. Together, the actuator 26, the block 82 and the parts associated therewith form the pump/valve mechanism of the invention.

A packing 84 seals around the valve rod 80 where it then enters a manifold 86. The valve rod 80 terminates in a valve disc 88 which is configured to seat against a valve seat 90. When the disc 88 is off the seat 90, fluid under pressure from the manifold 86 is free to flow out an outlet fitting 92.

Referring again to FIG. 1, the pump 11 provides fluid under pressure through the orifice 18 to the block 82 where it pressurizes the manifold 86. Depending on the position of the valve rod 80, fluid flows from the block 82 to the outlet fitting 92 or a waste discharge 94.

The pump/valve mechanism has appropriate fittings on it to enable connection of a lance feed line 32. The line 32 extends some distance, typically from 10 to 50 feet. Preferably the length of the line is kept relatively short so that pressure surges are not damped in the flow line.

The line 32 feeds fluid, including shock waves, to a lance 36. The lance 36 is coaxial with an elongate cylinder 37 which encloses a piston 38. The piston 38 is moved under hydraulic pressure in a double acting construction. This enables positive insertion and retraction of the lance. The hydraulic system preferably uses air from a suitable air pressure source delivered through a control valve 39 which connects to an air pressure regulator 40. The air pressure is regulated and provided to an air motor 41. The motor in turn is driven by the air to operate a hydraulic pump 42.

An inlet line 43 connects to hydraulic oil sump 44. Hydraulic oil is delivered to a control valve 45 to control the movement of the lance.

Specifically, the lance is extended when the valve is in the illustrated position. The lance is retracted when the valve moves to the opposite position. A return line 46 returns the low pressure oil to the sump. The valve is connected so that power is applied for extension of the lance and for retraction of the lance on operation of the valve. There is also additional equipment for positioning of the cylinder 37 as described below.

As shown in FIG. 1, the lance has an elongate rod portion which terminates at a tip 48. The lance tip is sized to nest in the end of a tube 50. A seal is made when the tube and tip make contact. The seal enables fluid to be introduced under pressure into the tube 50.

An air inlet line 51 introduces pressurized air into the block 82 and into the manifold 86. This permits the system to blow air through a tube to be cleaned prior the introduction of a shock wave of fluid from the system, thereby providing a water hammer to enhance the clearing effect of particularly stubborn blockages in tubes.

The lance 50 is moved with respect to a set of tubes in a fashion shown in FIGS. 3, 4, and 5. FIG. 3 shows the lance 36 which is supported and aligned by cylinder 37. It is mounted so that it travels on a pair of parallel rails 52 and 53 shown in FIG. 4 of the drawings. These permit movement in the X direction. The rails are parallel steel beams supported on rollers. A bracket is comprised of left and right frame members 54 and 55 which move as a unit. They enable vertical movement of the cylinder 37.

More specifically, the frame members 54 and 55 define a gap where the lance extends through the gap. The cylinder 37 is anchored to the spaced plates 56 and 57 which capture the cylinder. The cylinder extends into a pair of guide surfaces and is supported against these guide services for controlled movement. The guide surfaces are formed along the edges of the frame members 54 and 55 and thus define the channel 58 shown in FIG. 5 of the drawings. Rollers at 60 are located in this channel. There are typically four rollers, two at each corner as shown in FIG. 5, and a corresponding duplicate pair on the opposite side.

The several rollers guide the cylinder 37 for movement as illustrated. When it moves up or down, it is guided by the rollers 60 which clamp on the outside of the parallel frame members 54 and 55. As previously mentioned, the frame members are able to move as a unit to the left or right as viewed in FIG. 4. While this provides one dimension of movement, the movement in the vertical direction in FIG. 4 is the second dimension of movement. When the cylinder 37 is extended, the lance is moved in the Z direction toward the tubes 50.

Attention is now directed to FIG. 3 of the drawings where it shows the nozzle 48 at a particular tube 50. The tube 50 is one of many. In fact, hundreds of tubes can be constructed in the heat exchanger. The heat exchanger is defined by a head 64 better shown in FIG. 4 of the drawings. The extendible lance is forced against one of the tubes. The heat exchanger tube 50 is temporarily plugged by a plug 66 shown in FIG. 1 to perform the method of this invention.

In the practice of this method, the first step is to temporarily plug the tube 50 with the plug. The plug can leak somewhat. It is not important that it maintain a perfect seal; in fact, it is desirable that it provides some leakage so that the plug restricts flow but does not totally block fluid flow. The plug serves as a liquid flow barrier. Preferably it has a length equal to the diameter of the tube plus a friction of an inch greater length. If it were longer, it would work equally well, but it would also cause more frictional drag while the plug moves along the tube 50. In cleaning the tubes, the plug 66 is first placed in a tube and the lance is moved in an X and Y coordinate system until it is aligned with that particular tube. Then, the lance is extended and seats against the tube that has been plugged and the lance seats against the tube with a water-tight seal. As previously described, the tube is then blown free with pressurized air using air from the line 51.

The next step is to fill the tube with water. This is accomplished by pressurizing the manifold 86 from the pump 11 and holding the disc 88 off the seat 90. Fluid then flows through the lance to fill up the selected tube 50. At this point, the system is set up to deliver a series of repeated shock waves from oscillating action of the pump/valve mechanism. Movement of the actuator piston 70 back and forth moves the valve rod back and forth at the same rate. In the action, the disk and rod act as a pump, forcing flid under pressure with a pressure surge out through the lance. This has the form of a fluid shock which is administered through the solid column of water. When that occurs, there is a tube impact which jars the coating materials on the inside of the tube.

When this shock loading is formed in the tube, the plug 66 may leak or may be forced downstream. No particular problem arises from that because water is always being added through the pump output. The incorporation of the orifice 18 coupled with the standing column of water downstream assures that the system transmits into the dirty tube the cleaning shock wave. The shock wave has the form of a change in pressure propagated through the standing column of water. This forms a shock wave which is experienced in the tube but it is not a pressure wave which is built up behind the plug 66. In fact, it is not normal to use a plug to hold against high pump pressure. The plug is only a sufficient retardant to prevent complete escape of the water. The plug 66 will chatter and skid, moving finally to the far end of the tube 50. The system utilizes a positive displacement pump 11 which enables the system to provide a relatively constant fluid output. As the pressure buildup is formed and is switched by the pumping action of the pump/valve mechanism, the water in the tube serves to break up the coating of material on the inside of the tube.

As a generalization, a representative pressure at the discharge of the pump 11 may exceed 10,000 psi. The pressure at the tip of the lance 48 is preferably also in that range.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A system for cleaning a tube comprising:

(a) a source of fluid under pressure;

(b) a lance adapted to seal against the tube;

(c) a pump/valve mechanism to mechanically provide an oscillating pressure wave from the source to the lance, wherein the pump/valve mechanism comprises:

(i) an actuator; and (ii) a pump/valve block having a valve in the block, the valve coupled to the actuator with a linkage.

2. The system of claim 1, wherein the block defines a manifold and the valve controls the flow of fluid from the source of fluid under pressure to the lance.

3. The system of claim 2, further comprising a source of pressurized air into the manifold.

4. The system of claim 1, wherein the actuator is operated pneumatically.

* * * * *